United States Patent [19]

Saxby

[11] Patent Number: 4,531,458

[45] Date of Patent: Jul. 30, 1985

[54] COMPRESSED GAS POWERED AMMUNITION FOR SMALL ARMS

[75] Inventor: Michael E. Saxby, Norton Lindsey, England

[73] Assignee: Hilvenna Limited, England

[21] Appl. No.: 513,201

[22] Filed: Jul. 12, 1983

[51] Int. Cl.[3] ..... F42B 5/02

[52] U.S. Cl. ..... 102/440; 102/430

[58] Field of Search ..... 102/430, 440, 444; 124/57, 73, 74, 75

[56] References Cited

U.S. PATENT DOCUMENTS

| | | | |
|---|---|---|---|
| 387,256 | 8/1888 | Pratt | 102/430 |
| 2,308,798 | 1/1943 | Perker | 102/444 |
| 2,327,653 | 8/1943 | Lisle | 124/57 |
| 3,339,488 | 9/1967 | Borchers | 102/250 |

FOREIGN PATENT DOCUMENTS

| | | | |
|---|---|---|---|
| 16072 | 6/1898 | Sweden | 102/440 |
| 1601917 | 11/1981 | United Kingdom . | |
| 1601918 | 11/1981 | United Kingdom . | |

*Primary Examiner*—Harold J. Tudor
*Attorney, Agent, or Firm*—Neil F. Markva

[57] ABSTRACT

A round of ammunition comprising a missile 10, retaining means 11 for holding the missile, and a cartridge 12; and the cartridge 12 is an assembly comprising a hollow casing 13 within an intermediate portion of which is a gas storage space 18 disposed between a hollow discharge (front) end portion 14 and a base (rear) end portion 20 of the casing, discharge valve means 30 and actuating means 60. The actuating means generally comprises servo-piston means 61, servo actuating means 62 and discharge valve actuating means 63 arranged so that the means 62 is responsive to being struck by a firing pin 43 of a gun to allow the piston means 61 to utilize energy from compressed gas stored in the space to open the discharge valve means, and thus release the gas to expel the missile 10 from the retaining means.

7 Claims, 17 Drawing Figures

COMPRESSED GAS POWERED AMMUNITION FOR SMALL ARMS

FIELD OF THE INVENTION

This invention concerns cartridge ammunition for small arms, such as pistols, rifles and automatic small arms, which ammunition is adapted to utilise air or another gas at high pressures to propel missiles.

BACKGROUND OF THE INVENTION

In our British Patent Specification Nos.: 1601917 and 1601918 we disclose a form of ammunition which comprises a hollow outer casing, a pressure cylinder within the casing, valve means at one end of the cylinder, and a missile located in a mouth at a nose end of the casing, the pressure cylinder being slidable within the casing to cause the valve means to open and permit compressed air, contained in the cylinder, to flow from the cylinder to the mouth of the casing to expel the missile. The ammunition can be recharged with compressed air and a new missile, so as to be readily re-useable. This ammunition is hereinafter referred to as "ammunition of sliding cylinder form".

The ammunition was desinged for use in a firearm, with temporary modification of the latter to provide a barrel sleeve and a blunt firing pin, or for use in a similar weapon permanently adapted only to accept such ammunition to enable missiles of air gun pellet form to be employed for qualification as an air gun and not as a firearm under the Laws of certain countries.

While such ammunition of sliding cylinder form was effective when initially tested in particular guns under laboratory conditions, further trials revealed many disadvantages some of which could not be overcome by prolonged development of, and engineering modifications to, the ammunition and the guns. (As a result, our alternative form of practise ammunition, described in our British Patent Specification No. 2044896A, was developed for production and is now in use). Said disadvantages included wide variations in the accuracy and velocity of missiles fired under identical conditions using apparently identical ammunition, difficulties in recharging and reloading the ammunition, premature discharge risks, and incompatibility of the gun/ammunition combination with the Laws of certain countries. Further, said developments and engineering modifications, while overcoming or reducing some disadvantages would have been excessively expensive if put into production.

More recently the inventor has made certain further discoveries and improvements concerning ammunition generally of sliding cylinder form, which improved ammunition is being developed in conjunction with a new form of gun to avoid the said disadvantages, and to provide an improved and effective weapons system e.g. for target shooting. However, these cartridges being developed by us are bulky and the gun is of a new form.

This new weapons system will, to a considerable extent, satisfy the need, mentioned in particular in said Specification No. 1601918, for means enabling persons to practice shooting, which offers a combination of the advantages of standard air guns with the advantages arising from using cartridge ammunition, without the costs and hazards involved in the use of explosive propellants. However, the new weapons system has certain inherent limitations. For example, the improved ammunition cartridges are only compatible with the type of gun being developed or a gun especially and extensively modified, they are relatively bulky, and the firing of the sliding cylinder ammunition gives rise to recoil characteristics which, although small, are different from those of firearms and known air guns.

The general problems of bulk and recoil are to some extent interrelated, e.g. to store a given amount of energy in the pressure cylinder, the bulk (volume) of the cylinder can be reduced if the pressure is increased, but increasing the pressure increases the force needed to open the discharge valve means and thus requires the firing pin of the gun to have a greater momentum which produces recoil when the firing pin strikes the pressure cylinder. These problems are inherently applicable to the ammunition of sliding cylinder form.

In our British Patent Specification No. 1601918 it is mentioned that between the years 1880 and 1900 there were various proposed forms of compressed air powered ammunition for use in a suitable weapon for shooting, without some of the cost and other disadvantages inherent in using firearms; but such proposals were unsuccessful for various reasons, and since then the idea seems to have been abandoned. In fact, in Swiss Pat. No. 16072 granted in 1898 to Dr. J. Meuli-Hilty there was proposed a cartridge of a different type, which comprises a cylindrical pressure casing, a movable member (in the form of a hollow tube co-axial with the casing) and two spaced apart fixed members in the form of stuffing boxes secured in the casing. The tube extended through the stuffing boxes and was provided with two openings spaced apart so as to be closed by the stuffing boxes when the tube was in a first predetermined position. The tube had one end portion closed by a valve, which end portion was exposed at a rear end of the cartridge, and had an opposite end portion which terminated within a front part of the casing to the rear of a bullet seated in a front end of the casing. A spring urged the tube rearwards to bring a stop on the opposite end portion of the tube into contact with a front one of the two stuffing boxes. The large space between the stuffing boxes could be charged with compressed gas by removing a nut from a rear end of the tube, opening the valve, and rotating the tube to bring a rear one of the ports into alignment with a passage in the rear stuffing box. Thereafter, the valve was closed, the nut was replaced, and the cartridge was discharged by driving the tube forwards towards the bullet thereby bringing the front port to a small space between the bullet and the front stuffing box thereby allowing gas to escape from the large space to the small space via a restricted path comprising the passage, the rear port, the interior of the tube and the front port.

This proposed form of cartridge having a pressure casing does not appear to have been successful, and the proposal does not appear to have given rise to any subsequent developments, possibly because of the disadvantages inherent in the cartridge, in particular:

(a) the discharge path provides a severe restriction upon the rate of gas discharge whereas a rapid discharge is necessary;

(b) the stuffing boxes used to cover the ports would not have been effective to retain gas at the high pressure required for long periods, and any attempt to provide effective seals would have given rise to considerable frictional resistance to movement of the tube, unless the latter had a very small diameter; and (c) the procedure for charging the cartridge was complicated and required an externally accessible manually operable stop-cock form of valve.

However, this proposed form of cartridge having a pressure casing shows an item which is of interest. If the problem of sealing is ignored, for any given construction of the cartridge the force needed to move the tube to discharge the gas is substantially independent of the gas pressure existing in the large space, so that in this proposed form of cartridge the previously mentioned problem of bulk and recoil need not be interrelated. However, the problems and disadvantages mentioned in sub-paragraphs (a), (b) and (c) above have to be overcome.

The present invention generally concerns a rechargeable cartridge which has some similarity with that disclosed in Swiss Pat. No. 16072 of 1898, in that the cartridge is generally of a kind (hereinafter referred to as "the said kind") comprising a casing having a hollow interior within which is provided an internal gas storage space, which space is disposed between a hollow discharge (front) end portion of the casing and a hollow base (rear) end portion of the casing; and further comprising actuating means actuable to cause gas to be discharged from the storage space into said hollow discharge end portion, said actuating means having a movable member, which extends longitudinally within said internal gas storage space to said discharge end portion, and having a base end part accessible for striking by a firing pin for actuation of the actuating means.

An object of the present invention is to enable all these disadvantages and problems to be overcome or reduced.

SUMMARY OF THE INVENTION

According to the present invention there is provided a cartridge of said kind which is characterized, in accordance with the invention, in that:

(a) a piston is provided in the casing in or adjacent to the base end portion;

(b) the base end part of the actuating means is actuable by a thrust in a first longitudinal direction for causing, in use, the piston to be exposed to opposed unequal thrusts, one of which thrusts is provided by gas stored under pressure in the casing; and (c) said piston is movable by said unequal thrusts to move the movable member forcibly in a longitudinal direction opposite to said first longitudinal direction to open discharge valve means to allow gas to escape from said gas storage space through a discharge opening into said discharge end portion of the casing.

In all embodiments of the invention, the piston serves as a servo-piston to utilize energy from compressed gas stored in the casing to provide power for the actuating means to open discharge valve means for rapid discharge of the compressed gas into the hollow nose end portion.

The cartridge of the invention has the advantage that initial actuation of the actuating means is not substantially resisted by the gas pressure in the storage space, but unlike the cartridge shown in said Swiss Pat. No. 16072 and our aforesaid British Pat. Nos. 1601917 and 1601918 has the major advantages that the initial actuation only requires a small actuating force to be applied to the actuating means, and that initial actuation enables the stored gas pressure to be utilize by an integral servo-mechanism which acts rapidly and automatically to provide the large force required to open the discharge valve means. This servo-mechanism is constituted by the piston and the movable member, and acts by moving in the reverse direction; and the provision of the servo-mechanism enables a high flow capacity discharge valve means to be actuated. The accessible base end part of the actuating means thus serves as a or a part of a servo actuating means for actuating the servo mechanism.

To avoid sealing problems, the discharge valve means is preferably of a form which is urged to a positively closed position by the gas pressure in the gas storage space, and the provision and operation of this valve means is made possible by the existence of the servo-mechanism, which allows gas pressures of at least 100 kgm/sq.cm. to be employed.

The invention thus provides a round of ammunition comprising a missile and a cartridge containing gas at a pressure of at least one hundred kilograms per square centimeter, the cartridge comprising discharge valve means openable by a first force to discharge said gas, to expel the missile; said cartridge further comprising a servo-mechanism adapted to utilize energy from the stored gas to provide said first force, and servo actuating means actuable by a second force smaller than said first force.

The movable member serves as a discharge valve actuating member.

The discharge valve means is preferably arranged to serve, after the cartridge has been used, as an automatic non-return valve for charging the storage space with compressed gas to return the cartridge to a ready to use condition. The discharge opening is preferably disposed at one end of an internal discharge passage, via which passage gas is discharged and into which passage a gas charging tube can be sealingly inserted.

It will be readily appreciated that the cartridge of the invention can, in general terms, be defined as comprising:

(a) a hollow elongate casing having an intermediate portion between a base end portion and a discharge end portion, (b) a gas storage space provided in said intermediate portion for storing compressed gas, (c) discharge valve means normally closing a gas discharge opening between said gas storage space and said discharge end portion, (d) a servo-mechanism comprising a servo-cylinder in said base end portion and a servo-piston reciprocable in said cylinder, (e) actuating means disposed in said casing and comprising servo-actuating means accessible in said base end portion for striking and actuable by being struck to activate said servo-mechanism, siad actuating means further comprising a discharge valve actuating member extending from said servo-piston through said gas storage space to said discharge valve means, said discharge valve actuating member being operatively associated with the servo-piston and discharge valve means for opening the latter.

When the gas storage space is charged with compressed gas, actuation of the actuating means serves to unbalance forces acting on the piston of which forces is provided by the stored gas and provides power to energize the servo mechanism.

The cartridge of the invention has the further major advantage that, for a given overall cartridge diameter, length and burst strength, the volume of the gas space can be greater than the internal volume of the pressure chamber in the sliding cylinder form of ammunition described in our Patent Specification No. 1601918; and, because of the servo valve opening action, much higher gas pressures can be employed, so enabling the cartridge dimensions to be reduced, with respect to any given amount of gas to be stored, to the extent that the cartridge may be dimensioned to fit into a large caliber piston, revolver or rifle and still serve to store and rapidly discharge sufficient energy to propel a lightweight or sub-caliber missile at high velocity.

In some embodiments described herein, the actuating means comprises servo actuating means in the form of closure means, and the unequal thrusts are provided by the high pressure of the stored gas, an opposing lower gas pressure, e.g. atmospheric pressure, in combination with the thrusts or thrusts of various spring associated with the discharge valve means, the piston and/or the actuating means, which spring thrusts act against or with the thrusts derived from said pressures. Prior to actuation of the actuating means both sides of the piston are exposed to the same gas pressure (which pressure may be either the high stored gas pressure or the lower gas pressure), and actuation of the actuating means opens the closure means to open a gas flow path to one side of the piston to vary the pressure on that side, e.g. either to vent the high pressure from said side of the piston, or to apply the high pressure to said side of the piston.

Each of these embodiments is of the kind described, has spaced apart first and second walls at opposite ends of the internal gas storage space, the movable member extending longitudinally to said first wall, and is characterized, in accordance with the invention, in that:

(a) a piston is provided in the casing alongside the second wall;

(b) the base end part of the actuating means is actuable by a thrust in a first longitudinal direction to open closure means to cause the piston to be exposed, in use, to opposed unequal pressures, one of which pressures is provided by gas stored under pressure in the internal gas storage space; and (c) said piston is movable to said unequal pressures to move the movable member forcibly in a longitudinal direction opposite to said first longitudinal direction to open discharge valve means to allow gas to escape from said gas storage space through a discharge opening in said first wall into said discharge end portion of the casing.

In some of these embodiments, the base end part is movable relative to the movable member of the actuating means to open the closure means for exposing the piston to said pressure differential; and the piston is rigidly secured to the movable member. In one of these embodiments the piston and the servo cylinder are in the gas storage space, and actuation of the closure means opens a gas flow path to vent one side of the piston to atmosphere; whereas in another embodiment the piston and servo cylinder are outside the gas storage space, and actuation of the closure means opens a gas flow path to admit gas from the storage space to one side of the piston. In some of these embodiments, the gas flow path is provided by a servo passage provided directly in the second wall; whereas in other embodiments disclosed herein the servo passage is provided within the actuating means and the latter extends through the second wall for conveying gas through the second wall, and said base end part is movable to open the closure means to permit gas to flow through the servo passage.

The closure means may be servo valve means, or renewable frangible closure means, and may constitute the base end part of the actuating means.

The provision of a path (servo passage) to permit stored gas to flow to, from and/or through the piston involves problems of cost and function due to the necessary very small size of at least part of the path; and the closure means incurs costs, e.g. production costs for the servo-valve means or replacement costs for the frangible seals or closures. These further problems are overcome in a cartridge of the kind described, which is characterized in accordance with the present invention, in that:

(a) a piston is provided in the casing in or adjacent to the base end portion;

(b) the base end part of the actuating means is actuatable by a thrust in a first longitudinal direction to cause the piston to be exposed, in use, to opposed unequal thrusts, one of which thrusts is provided by gas stored under pressure in the casing;

(c) said piston is movable by said unequal thrusts to move the movable member forcibly in a longitudinal direction opposite to said first longitudinal direction to open discharge valve means to allow gas to escape from said gas storage space through a discharge opening into said discharge end portion of the casing, and (d) the actuating means comprises static or reactive thrust means movable between a blocking position in which it exerts a static or reactive thrust on the piston in opposition to said one of said thrusts, and an activated position in which said static or reactive thrust is removed from said piston.

Said static or reactive thrust means preferably comprises at least one rigid member disposed in said base end portion and a displacer which incorporates or constitutes said base end part of the actuating means, the displacer being actuatable to allow or cause the rigid member or members to move transversely relative to the piston. Displacer bias means is preferably provided to restore the displacer automatically to an un-actuated position.

An extension of the piston preferably serves as the movable member of the actuating means, and the discharge valve means is preferably mounted on said extension so that at least part of the discharge valve means is permitted to move through a limited distance in a predetermined direction from a normal position relative to said extension, to facilitate charging of the cartridge with compressed gas.

In all embodiments the discharge valve means is preferably of poppet valve form for closing said discharge opening. The effective area of the valve means is preferably no more than about half the working area of the piston. Said effective area may be as little as one tenth of said working area, but is preferably between one third and one fifth of the working area to enable the discharge opening to be made sufficiently large to permit the compressed gas to be discharged rapidly.

The piston is preferably arranged to accelerate through a predetermined distance before opening the discharge valve means, so that the opening of the latter is rapid and sudden, and said distance is preferably minimal to minimise the delay between actuation and opening of the discharge valve means.

The invention includes a round of ammunition comprising a cartridge of the invention, a missile and retaining means to releasably retain and connect the missile to the cartridge.

BRIEF DESCRIPTION OF DRAWING

The invention will be described further, by way of example, with reference to the accompanying diagrammatic drawings, wherein.

DETAILED DESCRIPTION

Figure 1:
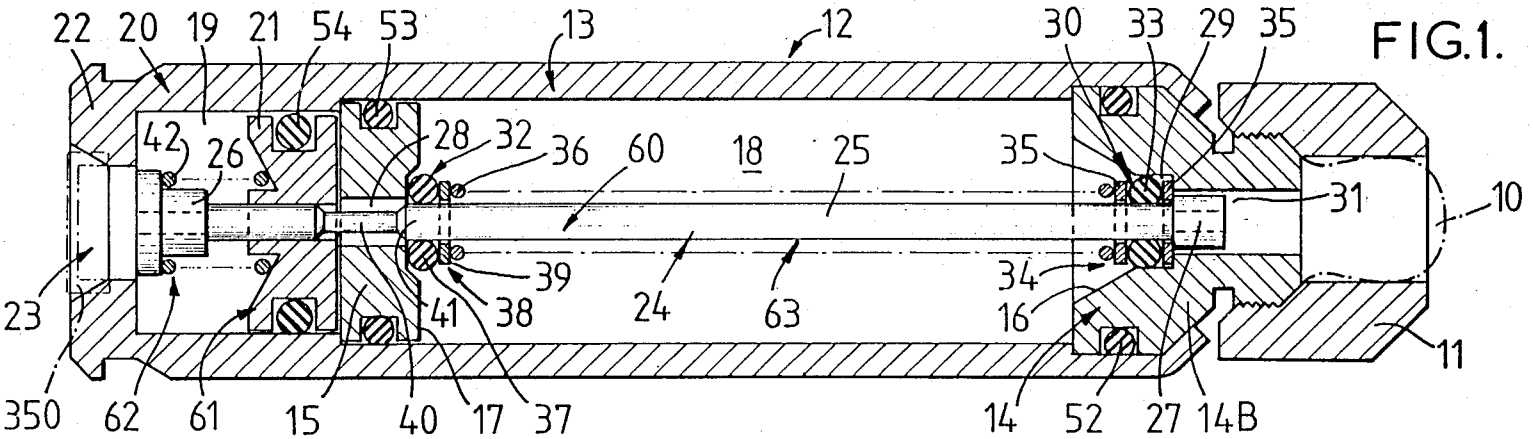
FIG. 1 shows a longitudinal cross section through a first embodiment of a round of ammunition incorporating a cartridge in accordance with the invention.

In all the embodiments and modified forms thereof described hereinafter, the rounds of ammunition generally comprise a missile 10, retaining means 11 for holding the missile, and a cartridge 12; and the cartridge 12 is an assembly comprising a hollow casing 13 within an intermediate portion of which is a gas storage space 18 disposed between a hollow discharge (front) end portion 14 and a base (rear) end portion 20 of the casing, discharge valve means 30 and actuating means 60. The actuating means generally comprises servo-piston means 61, servo actuating means 62 and discharge valve actuating means 63 arranged so that the means 62 is responsive to being struck by a firing pin 43 of a gun to allow the piston means 61 to utilize energy from compressed gas stored in the space 18 for forcing the discharge valve actuating means to open the discharge valve means 30 to permit said gas to leave said space and expel the missile 10 from the retaining means.

Referring to FIGS. 1 to 4, the first embodiment of the round of ammunition comprises the missile 10, the retaining means 11, in the form of a screw-on removable nosepiece, and the cartridge assembly 12. In the discharge end portion 14 of the casing 13, there is an end member 14B, and in the base end portion 20 there is an internal member 15. The members 14B and 15 are located in predetermined spaced apart positions so as to define a first wall 16 and a confronting second wall 17 within the casing 13, whereby to define within the casing the gas storage space 18. The internal member 15 serves as a partition within the casing between the space 18 and a servo-cylinder 19 in the base end portion 20 of the casing. The piston means 61 comprises a piston 21 slidably located in the cylinder between said internal member 15 and a base 22 of the casing. The base has a central aperture 23.

The discharge valve actuating means 63 comprises an elongate movable member 24 which comprises a rod 25 having a base end part 26, of collar form, and a nose end collar 27. The rod 25 extends slidably through the piston 21, through a servo passage 28 in the internal member 15, through the space 18 through a gas discharge opening 29 (FIG. 3) in the first wall 16, to project into a gas discharge passage 31 in the end member 14B.

The rod 25 also extends through first sealing means 34, associated with the first wall 16, and second sealing means 32, associated with the second wall 17.

The first sealing means 34 comprises an elastomeric O-ring 33 and serves as part of the discharge valve means 30. The latter further comprises spaced apart rigid washers 35 which are slidably located on the rod 25 to embrace the O-ring 33 therebetween, and is biased by a discharge valve and sealing bias spring 36 to closed position (FIGS. 1 and 2) in which the O-ring 33 engages in the wall 16 to close the opening 29.

The servo actuating means 62 comprises closure means in the form of servo valve means 38. The second sealing means 32 comprises an O-ring 37 and serves as part of the servo valve means 38. The latter further comprises a rigid washer 39, and a valve portion 40 of the rod 25. The valve portion 40 has a smaller transverse cross sectional area than the adjacent portion 41 of the rod, which portion 41 is normally embraced by the O-ring 37 while the valve means 38 is closed. The spring 36 urges the O-ring 37 against the wall 17 so as to close the servo passage 28.

A piston bias spring 42 is located around the rod 25 and acts between the base end collar 26 and the piston 21 firstly to urge the piston 21 towards the internal member 15 and secondly to urge the movable member 24 towards the base aperture 23 to urge the collar 27 to abut the discharge valve means 30.

Peripheral "O" ring seals 52, 53 and 54 are provided for the members 14A, 15 and the piston.

Figure 2:
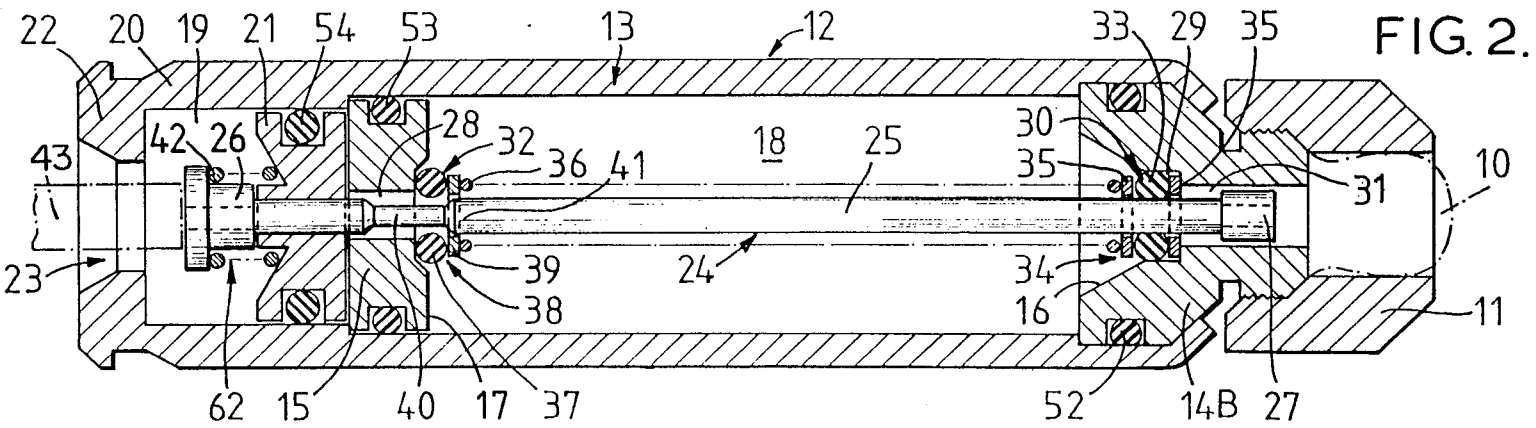
FIG. 2 shows part of the cartridge in a transient initially actuated state.

In use, compressed gas contained in the space 18 of the cartridge can be discharged rapidly, to expel the missile 10 from the nosepiece 11, by causing a firing pin 43 to enter the base aperture 23 and strike the base end part 26 to move the actuating member 24 forwards slightly (towards the discharge end) to the transient position shown in FIG. 2. The total force required to move the actuating member includes the small force necessary to compress the spring 42, and the further small forces required to cause the rod 25 to slide through the O-rings 33 and 37 which latter forces are only slightly affected by the pressure pertaining in the space 18. In the transient position the valve portion 40 lies within the O-ring 37 thus allowing gas to pass therebetween and enter the cylinder 19, via the servo passage 28, whereby to exert a driving thrust on the piston 21; but the discharge valve means 30 remains closed.

Figure 3:
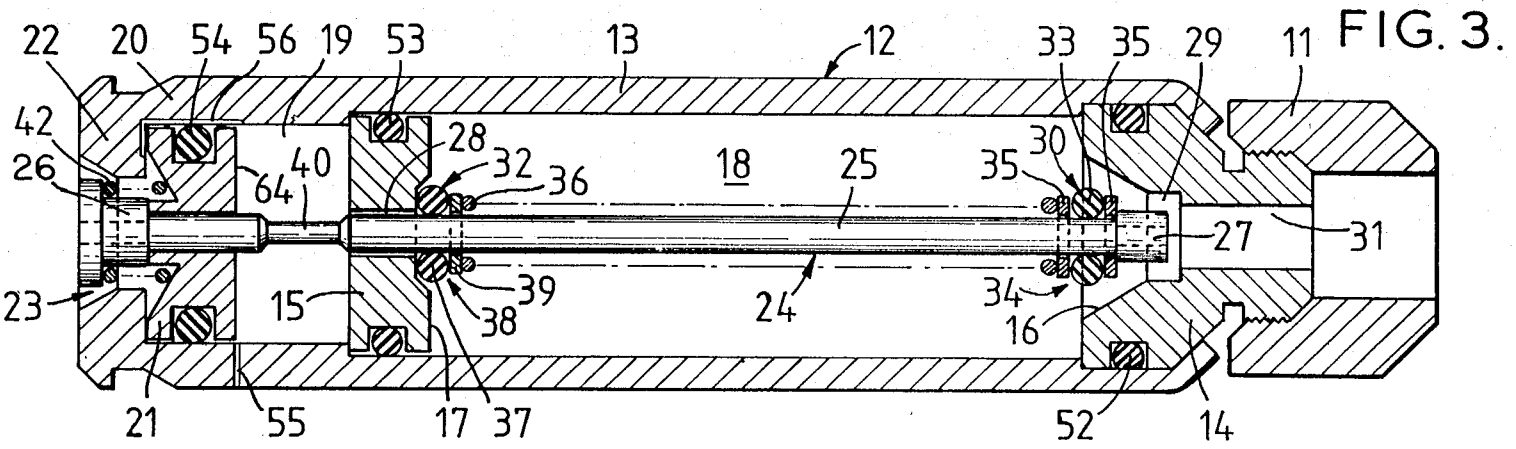
FIG. 3 shows parts of the cartridge in a discharging state.
Figure 4:
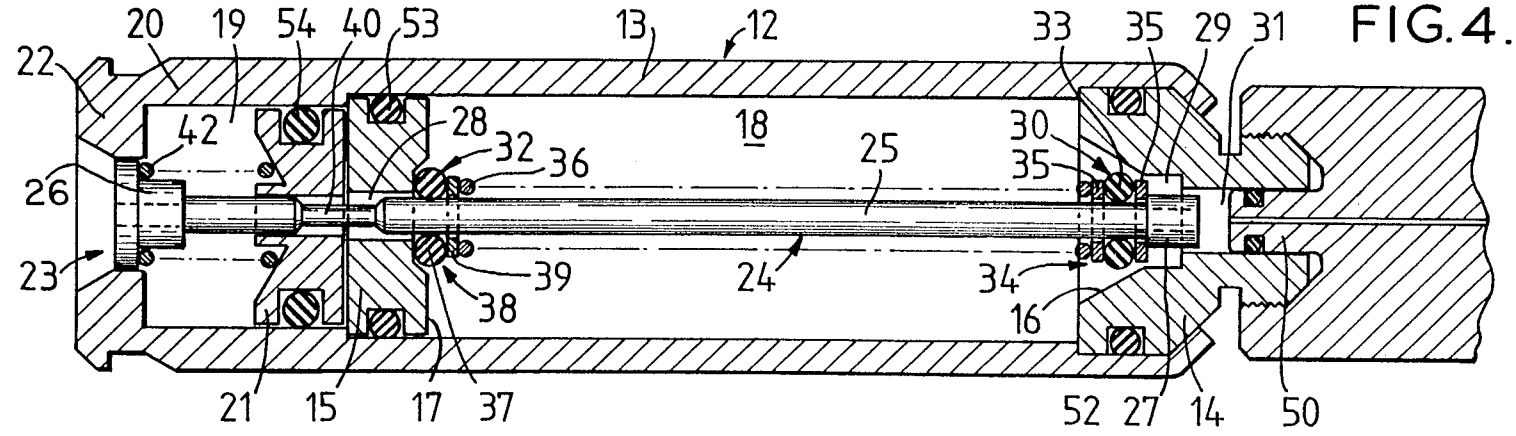
FIG. 4 shows parts of the cartridge in a charging state.

The driving thrust acts on the front or working face 64 (FIG. 3) of the piston 21 adjacent the integral member 15 to drive the piston 21 towards the base 22, and the piston 21 in turn transmits said driving thrust to the collar 26 to drive the movable member 24 forcibly and rapidly towards the base 22 to the discharge state shown in FIG. 3. This movement of the member 24 causes the member 24 to abut and move the discharge valve means 30 from the opening 29 against a resistance comprising the thrust of the spring 36 and the thrust exerted on the valve means 30 by the compressed gas. This resistance is much less than the driving thrust because the working area of the piston 21 (i.e. the area of the face 64) is several times larger than the effective area of the discharge valve, e.g. about six or more times larger.

In the discharge state, the opening 29 and passage 31 provide a short, direct and high flow capacity route for the compressed gas to flow rapidly from the storage space 18 to the nosepiece.

After discharge of the stored gas, the pressure in the cylinder declines (due to leakage of gas through the piston along the central bore slidably accommodating the rod 25) eventually allowing the springs to restore the cartridge to the initial state shown in FIG. 1, but in a discharged condition.

The member 24 and the discharge valve means 30 also serve as automatic non-return valve means for charging the cartridge with compressed gas. If the whole cartridge is exposed to a high pressure atmosphere, the member 24 and valve means 30 will be forced to move against the bias of the spring 36 to the state shown in FIG. 4. thereby admitting said high pressure atmosphere into the space 18 until the internal pressure rises to close to the external pressure allowing the bias to return the member 24 and the valve means 30 to the state shown in FIG. 1, for returning the cartridge to the charged, in use, condition.

Alternatively, the nosepiece 11 may be unscrewed and removed, and the cartridge screwed into a socket to engage a charging tube 50 in the discharge passage 31, to permit gas to be pumped into said passage for charging the cartridge.

Figure 5:
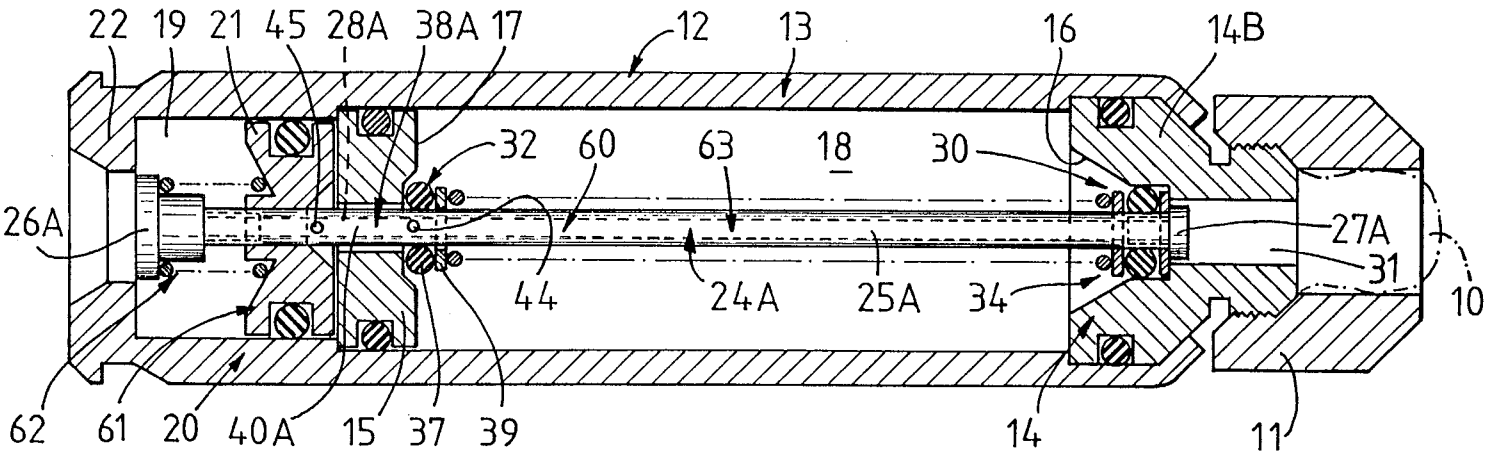
FIG. 5 shows a longitudinal cross section through a modified form of the round of ammunition, shown in FIGS. 1 to 4.

Referring to FIG. 5, the modified round of ammunition shown in FIG. 5 is functionally equivalent to the embodiment shown in FIG. 1, so that some common parts are indicated by the same reference numbes and are not described further, whereas functionally modified parts are indicated by equivalent numbers with the suffix A.

The member 24A comprises an elongate tube 25A having a collared base and plug 26A and a collared discharge end plug 27 screwed into opposite ends of the tube 25A. The closure means is provided by modified servo-valve means 38A comprising the O-ring, washer 39 and a valve portion 40A of the tube 25A. The valve portion 40A has spaced apart sets of ports 45 and 44 which serve, together with the interior bore of the tube 25A, as the servo-passage 28A. In use, 28A passage is normally closed by the second sealing means 32 until the actuating means is actuated as described with reference to FIG. 2, whereupon the ports 44 are shifted through the second sealing means to admit compressed air from the space 18 into the passage 28A, which air flows from the passage via the ports 45 into the cylinder 19 to drive the piston 21 towards the base 22.

Figure 8:
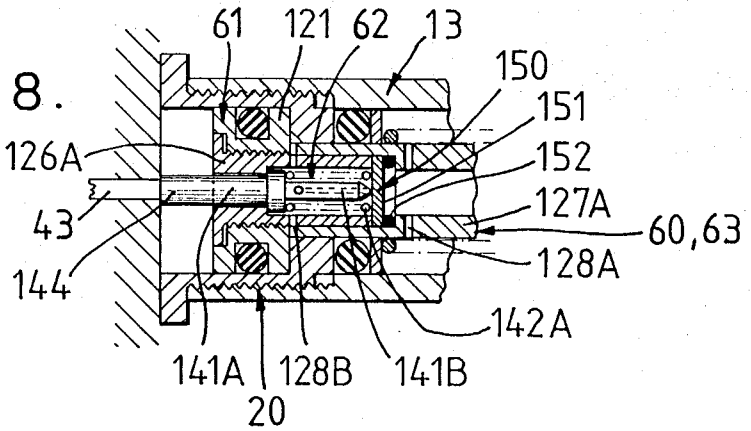
FIG. 8 shows a detail of a modified form of the second embodiment shown in FIGS. 6 and 7.
Figure 6:
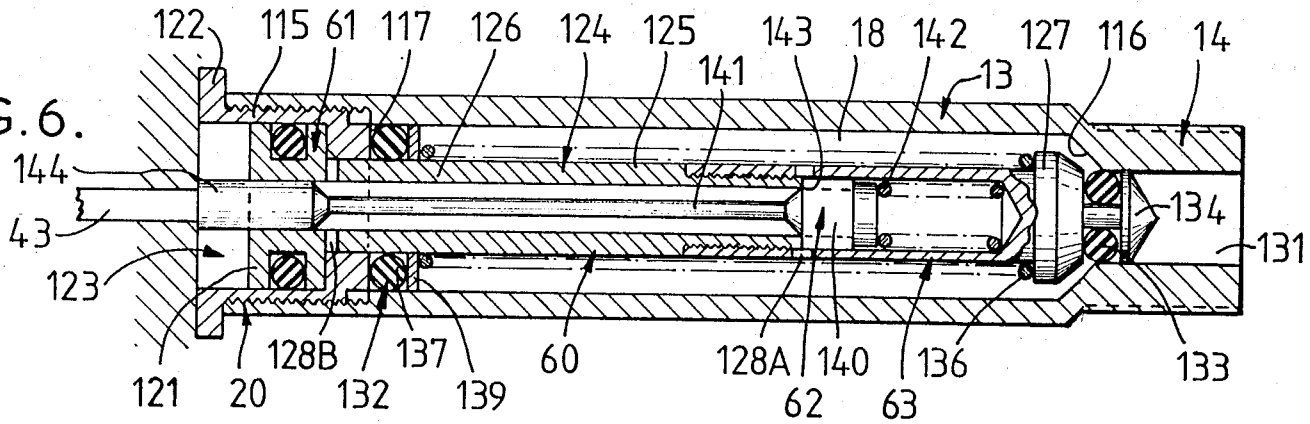
FIGS. 6 and 7 show longitudinal cross sections through a second embodiment of cartridge of the invention in a normal state and in a discharging state respectively.
Figure 7:
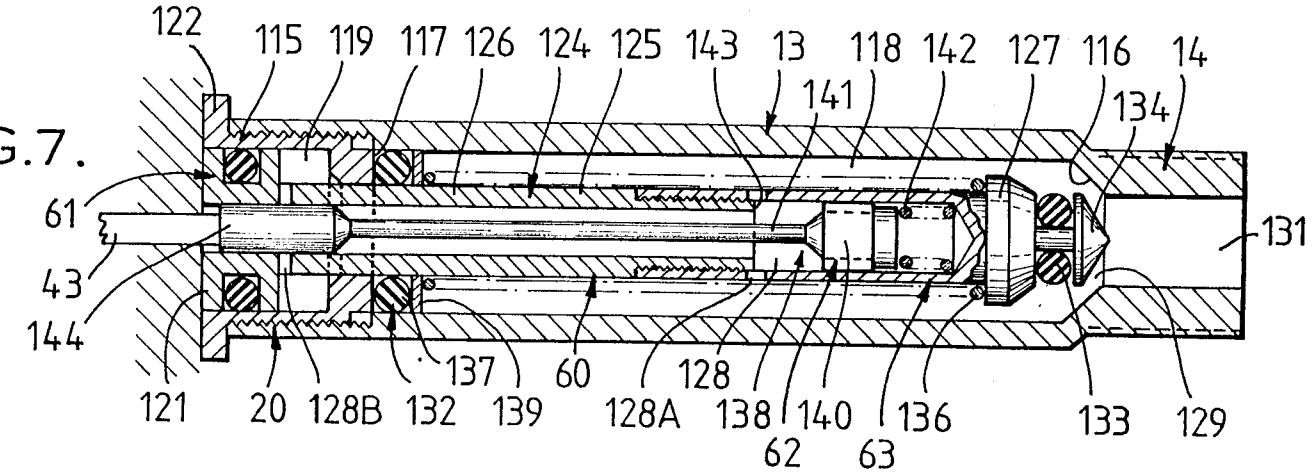

Referring to FIGS. 6 to 8 of the drawings (from which the missile 10 and retaining means 11 are omitted), in the second embodiment of cartridge assembly the casing 13 has a single insert member 115 in the base end portion 20. The discharge end portion 14 integrally defines a first wall 116, and the member 115 defines a second wall 117 confronting the first wall 116 whereby to define, within the intermediate portion of the casing, the gas storage space 18. The portion of the insert member 115 defining the second wall 117 serves as a partition within the casing between the space 18 and a servo-cylinder 119 in the base end portion 20 of the casing. The piston means 61 comprises a servo piston 121 slidably located in the cylinder 119 between said partition 117 and a base 122 of the casing. The base has a central aperture 123.

The actuating means 60 comprises a movable member 124 comprising a hollow rod assembly 125, having a hollow rear part 126 (integral with the piston) and a front part 127. The rod assembly 125 extends slidably through the partition 117, through the space 18 and through a gas discharge opening 129 (FIG. 3) in the first wall 116, to project into a gas discharge passage 131 in the discharge end portion 14.

The rod assembly 125 extends through sealing means 132 associated with the second wall 117, and serves as part of the discharge valve actuating means.

The discharge valve actuating means comprises an elastomeric O-ring 133 and an end part 134 of the part 127, and is biased by a discharge valve and a sealing bias spring 136 to a closed position (FIG. 6) in which the O-ring 133 engages in the wall 116 to close the opening 129. The end part 134 is a clearance fit in the passage 131.

The sealing means 132 comprises an O-ring 137 and a rigid washer 139, and the spring 136 urges the O-ring 137 against the wall 117, the casing 113 and the rod assembly 125.

The bias spring 136 is located around the rod assembly 125 and acts thereon to urge the piston 121 forwards towards the internal member 115.

The actuating means 60 serves to define a servo passage 128 which comprises the hollow interior of the rod assembly 125 and bores 128A,B which lead respectively to the space 18 and to the cylinder 119 (between the piston and the second wall) for conveying compressed gas from said space 18 through the second wall 117 to the cylinder.

In the embodiment shown in FIGS. 6 and 7 the servo actuating means 62 comprises closure means is in the form of servo-valve means 138 comprising a sealing member 140 mounted on a plunger rod 141 slidable in the rod assembly 125. A servo-valve spring 142 within the assembly 125 urges the rod 141 to a valve closed position in which the member 140 engages a seating 143 on the part 126 to close the passage 128, and in which position a base end part 144 of the rod 141 projects through the piston 121 so as to be exposed at the open base end of the casing.

In use, the part 144 is driven forwards (towards the nose) by the force of a firing pin 43 to lift the member 140 off the seating 143 thereby opening the passage 128 allowing compressed gas to drive the piston and rod assembly rearwards to open the discharge valve means 134, as shown in FIG. 7.

The second embodiment can be recharged with compressed gas in the same manner as the first embodiment.

In the modified form of the second embodiment shown in FIG. 8, the closure means is in the form of a frangible closure 150 comprising a frangible disc 151 clamped against a sealing ring 152 by a shorter rear end part 126A which screws into a modified front part 127A which is extended to be integral with the piston 121. Both bores 128A and B are provided in the part 127A. The short plunger rod 141A is biased rearwards by a servo-spring 142A located around a grooved or hollow piercing spike 141B, which is adapted to pierce the disc 151 to open the servo passage when the base end part 144 is struck by a firing pin 43. The part 126A can be unscrewed and withdrawn to permit replacement of the pierced disc with a new disc 151. The portions of the round omitted from FIG. 8 are the same as those shown in FIG. 6, and in this modified form the "O" ring 133 serves as a non-return valve during recharging as compressed gas is forced to flow past the end part 134.

In the foregoing first and second embodiments and modified forms thereof, the servo-piston means 61 and servo cylinder are adjacent the second wall and outside the compressed gas storage space; and both the front discharge side and the rear (base) side of the piston are normally at atmospheric pressure. Opening of the servo passage subjects the front or working face of the piston to pressure derived from the stored compressed gas so that the piston is subjected to a pressure differential providing all the energy necessary for moving the piston rearwards for opening the discharge valve means 30.

In the following third embodiment and modified form thereof described with reference to FIGS. 9, 10 and 11, the servo-piston means 61 and servo cylinder are inside the compressed gas storage space 18, and both sides of the piston are normally subjected to the pressure of the stored gas. The servo actuating means 62 is in the form of closure means and opening of the servo-passage subjects the rear side of the piston to lower, e.g. atmospheric pressure, by venting of the gas behind the piston, to subject the piston to said pressure differential thereby causing the piston to move rearwards for opening the discharge valve means 30. The missile 10 and the returning means, in the form of a snap-on nosepiece, are not shown.

In the third embodiment of cartridge assembly, the discharge end portion 14 of the casing 13 is of simple one piece form, and the base end portion 20 is internally grooved. An insert member 215 is retained in the base end portion by a circlip 200 engaged in the groove in said portion 20. The portion 14 defines a first wall 216, and the member 215 defines a second wall 217 confronting the first wall whereby to define, within the casing, the gas storage space 18 which in this embodiment extends rearwards beyond the intermediate portion of the casing and into the base end portion 20. The insert member 215 serves as a partition between the space 18 and the open end of the portion 20, and defines a servo passage 228 which extends through the second wall.

The piston means 61 comprises a piston 221 slidably located in the space 18 adjacent the second wall 217 to divide the space into a main storage portion 218 in front of the piston, and a servo cylinder portion 219 in which the piston can move.

Figure 9:
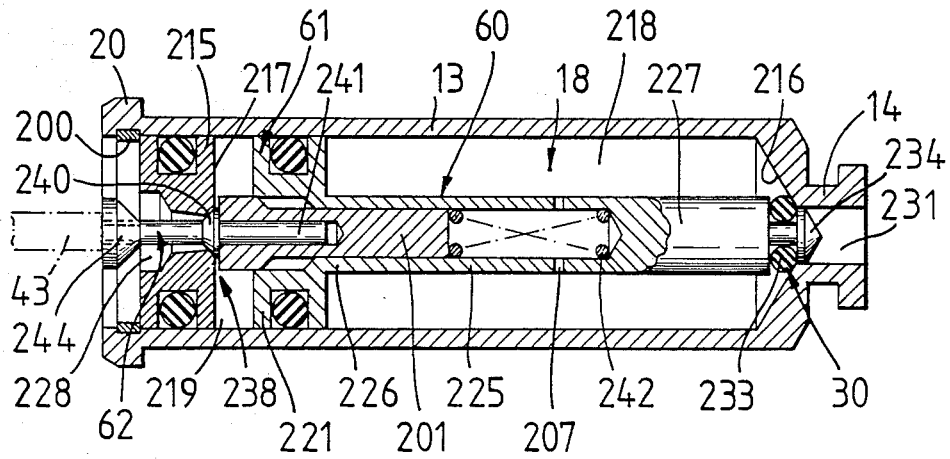
FIGS. 9 and 10 are views similar to FIGS. 6 and 7 showing a third embodiment of the invention.
Figure 10:
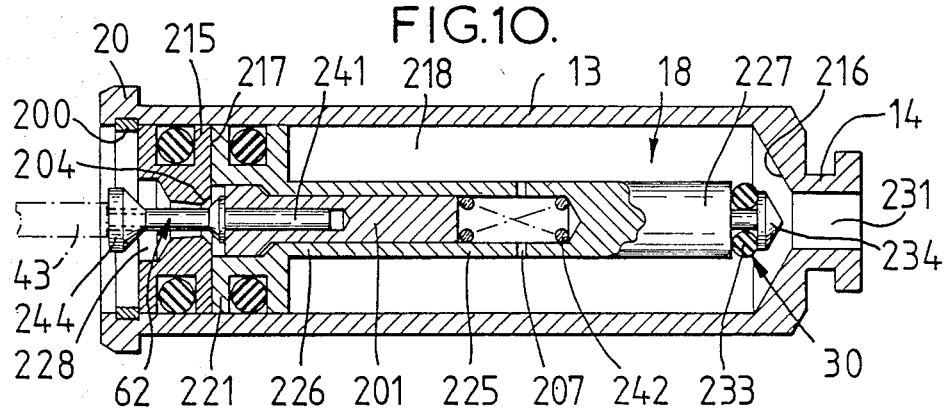

The actuating means 60, in the third embodiment shown in FIGS. 9 and 10, comprises a movable member 225 having a hollow rear portion 226 (integral with the piston 221) and a front portion 227. A bush 201 is slidably accommodated (as a clearance fit) in the portion 226, and a servo valve spring 242 is trapped in the portion 226 between the bush 201 and the front portion 227. A restricted charging passage 202 is provided in the portion 226 to allow gas to pass from the main storage portion 218 through the portion 226 along the outside of the bush 210 to the servo cylinder portion 219. The closure means is in the form of servo valve means 238, which comprises a valve member 241 which extends through the passage 228 into the bush 201. The spring 242 urges a sealing part 240 of the valve member 241 into engagement with a seating 204 (FIG. 10) on the insert member 215 to close the passage 228. A base end part 244 of the member 241 is disposed in the base-end portion 20 so as to be exposed. The spring 242 also serves as a sealing bias spring to urge the portion 227 towards the first wall 216 for closing the discharge valve means 30. The discharge valve means 30 comprises an "O" ring seal 233 and an end part 234 of the front part 227, which part 234 is a clearance fit in a discharge passage 231.

Figure 11:
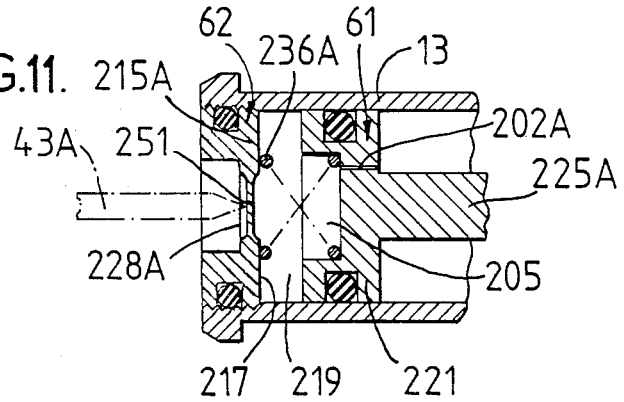
FIG. 11 shows detail of a modified form of the third embodiment shown in FIGS. 9 and 10.

In the modified form of the third embodiment shown in FIG. 11, the movable member 225A is solid except for a recess 205 for sealing bias spring 236A for closing the discharge valve means 30, and for a restricted charging passage 202A; and the closure means is in the form of an exposed frangible web 251 integral with a screwed in insert member 215A so as to close the servo passage 228A, which member 215A has an "O" ring peripheral seal. The unshown remainder of the cartridge is the same as shown in FIG. 9.

In use, when the closure means is opened by being struck by a firing pin 43 or 43A to open the servo passage, pressure in the servo cylinder portion 219 falls to atmospheric pressure, and the piston 221 moves to abut the wall 217 thus opening the discharge valve means, e.g. as shown in FIG. 6. In the modified form the pointed firing pin 43A is required to pierce the web 251 which serves as an exposed base end part of the actuating means. The member 251A can be unscrewed and replaced by a new member 251A.

In the first three embodiments and the modifications thereof, in the charged condition of the cartridge, the servo piston means 61 is subjected to two balanced opposing thrusts both deriving either from atmospheric pressure (as in the first and second embodiments) or from the stored gas pressure (as in the third embodiment); and the servoactuating means 62 is operable, in use, to cause a change in the pressure acting on one side of the piston to unbalance the two opposing thrusts. However, these embodiments all require the servoactuating means 62 to incorporate closure means, a barrier or partition and a servo passage which collectively serve as means for controlling gas flow.

In the fourth embodiment and a modified form thereof described with reference to FIGS. 12 to 17, the servo actuating means 62 is in the form of static or reactive thrust means of a mechanical form which, in the non-actuated state of the servo mechanism, provides a static thrust to the piston in reaction to the thrust provided by the stored gas pressure, and thus obviates the need for such means for controlling gas flow; and with the exception of certain seals e.g. "O" rings, the cartridges are all of metal construction.

Figure 12:
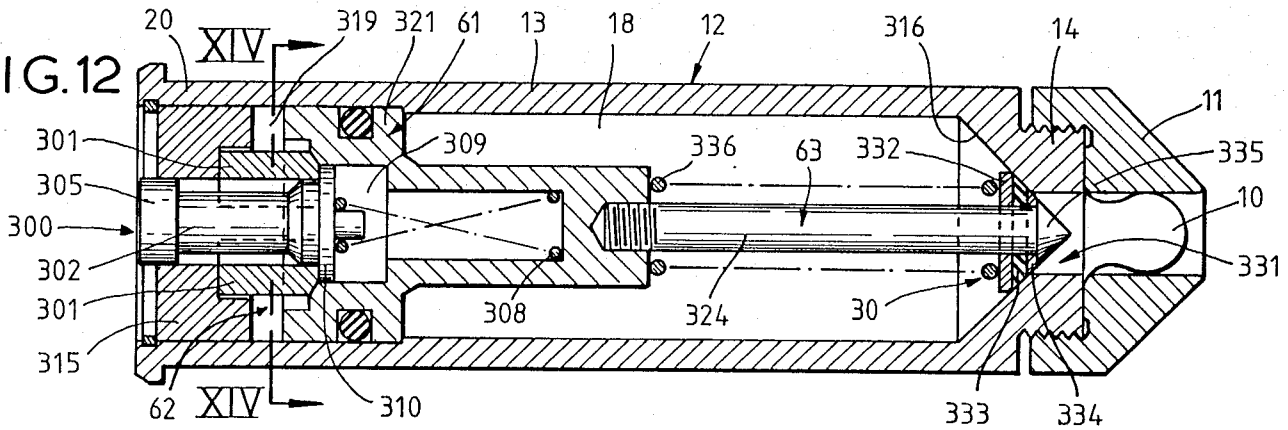
FIG. 12 shows a fourth embodiment of a round of ammunition in accordance with the invention, in longitudinal cross-section in a loaded condition.
Figure 14:
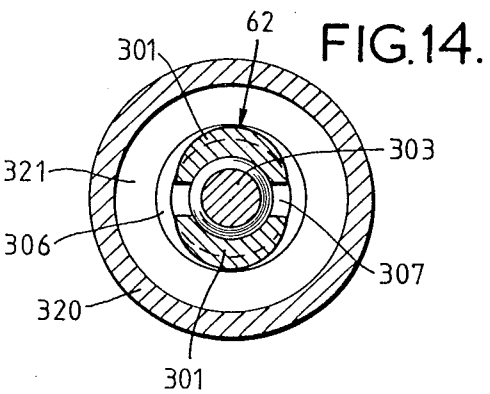
FIG. 14 shows an enlarged cross-section on the line III—III in FIG. 12.
Figure 13:
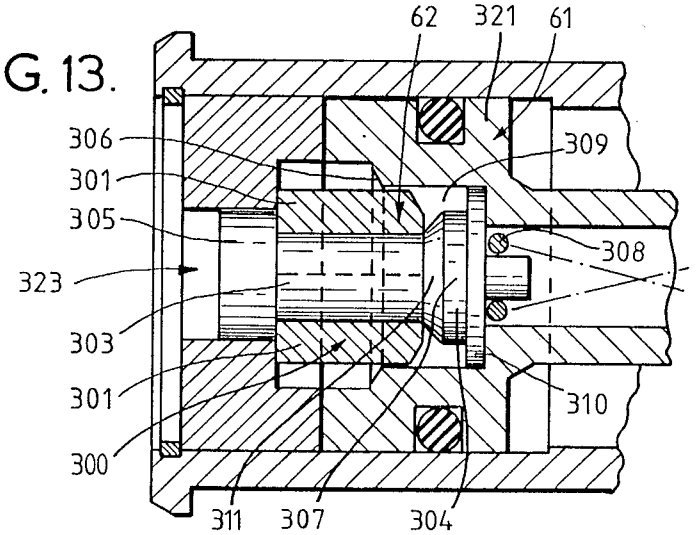
FIG. 13 shows an enlarged detail of part of the round after firing.

Referring to FIGS. 12 to 14, the fourth embodiment of the round of ammunition comprises the missile 10, the nosepiece 11 and the cartridge 12. The latter is an assembly in which the discharge end portion 14 is integral with the casing 13, and the assembly includes an internal member 315 which is held by a circlip in the base end portion 20 of the casing. The member 315 has a central aperture 323.

The base end portion 20 provides a servo cylinder 319 at one end end of a gas storage space 18 for the servo-piston means 61 which comprises a piston 321. The space 18 extends from the piston and through the intermediate portion of the casing to a first wall 316 defined by the discharge end portion 14. Discharge valve means 331 is provided to close a discharge aperture in the first wall at the rear end of a discharge passage 331.

The discharge valve means 30 comprises a bias spring 336 which acts on a backing washer 332 to compress an elastomeric secondary sealing ring 333 against a valve member 334 which abuts a head 335 at the end of a movable member 324. The valve member 334 has a 45° conically tapered seating face which sealingly engages the similarly tapered wall 316 around the discharge aperture, and the ring 333 engages the wall at the junction between the periphery of the valve member and the wall to seal said junction against ingress of gas stored at very high pressures.

The discharge valve actuating means 63 comprises the movable member 324, extending within the space 18 from the piston to the valve means 331; and the servo actuating means 62 comprises static thrust means 300 disposed in the base end portion 14. The static thrust means comprises a pair of rigid members 301 and a displacer 302 disposed between said members 301. The displacer (FIG. 13) has a waist 303 between a head 304 and a base end part 305 exposed centrally at the base end of the cartridge casing 13.

In use, in the loaded and charged condition of the round as shown in FIGS. 12 and 14, the static thrust means 300 is in a blocking condition in which the rigid members 301 abut a tapered part conical abutment surface 306 of the piston and are supported against movement towards the axis of the piston by engagement with the peripheral surface 307 of the head 304. The piston is urged rearwards towards the base of the cartridge by a major thrust of the pressure of the gas stored in the space 18 and the much smaller thrust of the spring 336; and these thrusts are opposed by by the static resistive or reactive thrust exerted by the rigid members 301 on the piston, together with the thrust of the lower pressure, e.g. atmospheric pressure, existing in the cylinder to the rear of the piston, and the thrust of a displacer resetting spring 308 acting between the piston and the static thrust means, so that the piston is held in an un-actuated state and the discharge valve means remains closed.

The base end part 305 is exposed at the base so that, when the round is in the breech of a gun, the part 305 can be struck and moved forwards (towards the nose) by a firing pin of a gun. When the head 304 is moved forwards from between the rigid members 301, the inclination of the surface 306 causes the rigid members to move into the waist 303. The dimensions of the rigid members and waist are such that they can be accepted in a recess 309 in the rear of the piston thereby allowing the piston to move rearwards to an actuated position in which it is abuts to the internal member 315 as shown in FIG. 13.

Rearward movement of the piston and the movable member 324 pulls the valve means 331 from the first wall, to discharge the gas through the discharge end portion, thus expelling the missile.

The resetting spring 308 is stronger than the valve bias spring 336 so that, when the pressure in the space 18 drops to near atmospheric pressure, the spring 308 automatically restores the piston to the un-actuated position closing the valve means, and also thrusts the displacer rearwards so that a part conical surface 311 between the head and the waist thrusts the rigid members radially outwards to the blocking position so that the cartridge is restored to the mechanical condition shown in FIG. 12. A washer 310 ensures that the rigid members 301 are ejected from the recess 309.

The cartridge can be recharged by pumping compressed gas into the discharge passage thereby causing the valve parts 332, 333 and 334 to move rearwards along the movable member 324 so opening the valve means against the bias of the spring 336. The discharge valve means thus serves as automatic non-return valve means during charging of the cartridge.

The static thrust means may be of any suitable form. For example, simpler part cylindrical rigid members may be employed instead of the rigid members shaped as shown in FIGS. 12 to 14. A single rigid member may be used in combination with means, such as a spring or an eccentric formation of part of the displacer, to hold the rigid member in an eccentric blocking position, the displacer being shaped and movable to move the rigid member to a position concentric or aligned with the recess 309 to actuate the piston.

Figure 15:
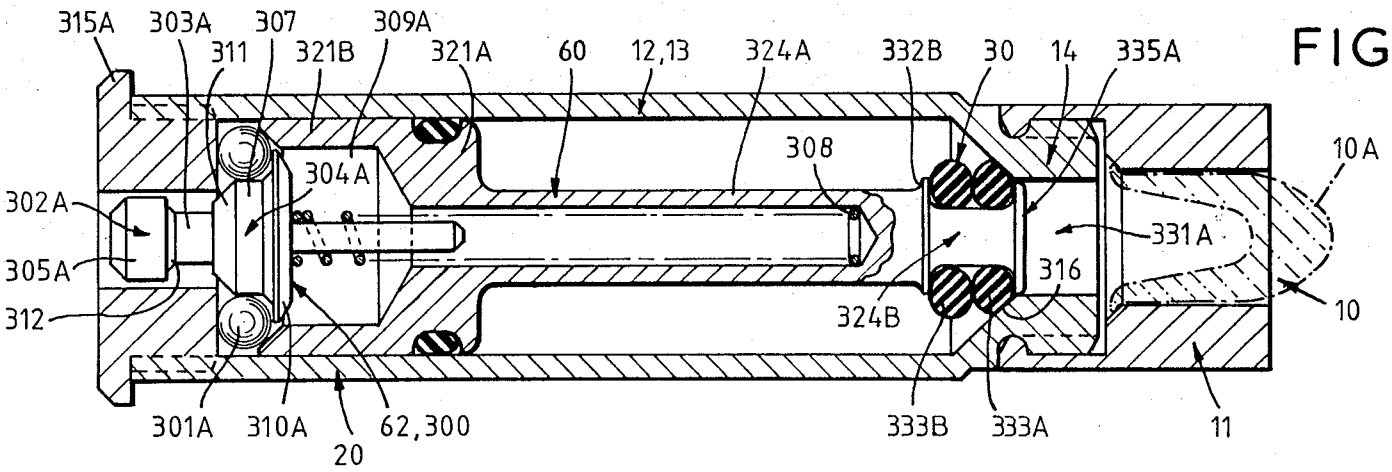
FIGS. 15 and 16 show, in longitudinal cross-section a modified form of the fourth embodiment, in a loaded state and in a discharging state respectively.
Figure 16:
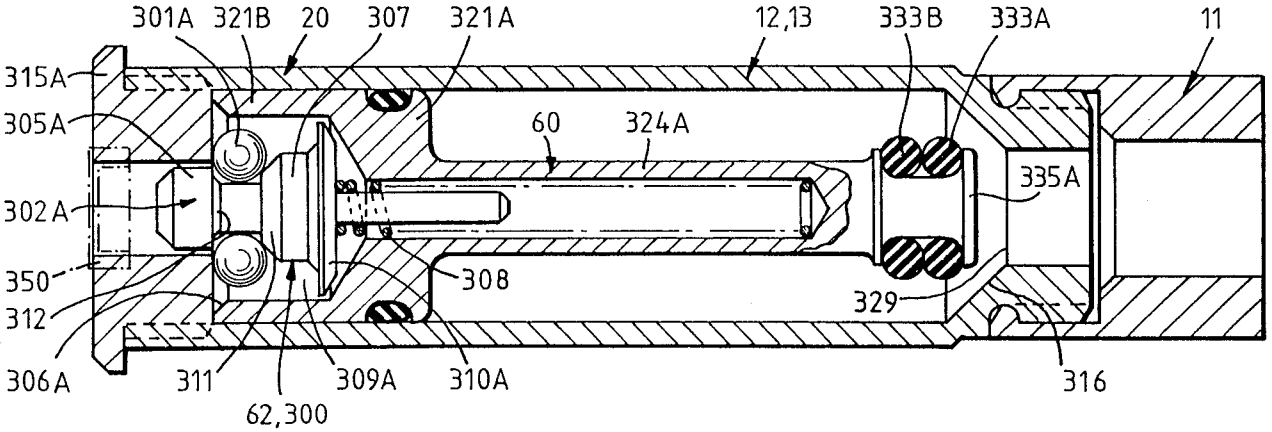
Figure 17:
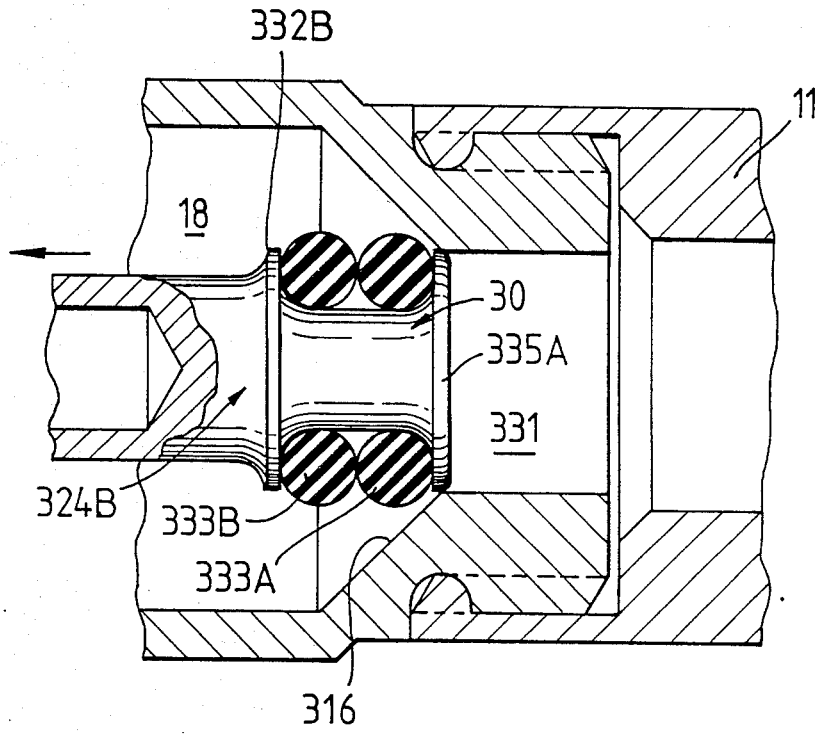
FIG. 17 shows an enlarged detail of part of the round shown in FIGS. 15 and 16, in a transient state after initial actuation.

It should be noted that in the original drawings accompanying this application FIGS. 15 to 17 are approximately to scale and the various parts of shown therein are shown in their correct relative proportions and sizes; whereas in the remainder of the drawings the parts shown in FIGS. 1 to 14 are not necessarily to scale and are not necessarily shown in their correct relative proportions.

The modified form of the fourth embodiment, shown in FIGS. 15 to 17, is similar to the fourth embodiment, but the modified form incorporates several improvements in its detail construction and arrangement, and is intended as a substitute for a .38 special firearms cartridge, for use in a firearm provided with a barrel liner.

In this modified form the static thrust means 300 employs several rigid members in the form of six ball bearings balls 301A, each ball having a diameter of 2 mm. The displacer 302A is a one piece hardened steel part which is machined to provide the peripheral cylindrical surface 307, and the part conical surface 311 on a modified head 304A which integrally incorporates a flange 310A instead of the washer 310 shown in FIG. 10. A further part conical surface 312 is provided between the shortened waste 303A and the base end part 305A. This form of the static thrust means is less expensive and is easier to assemble and is more reliable in operation than the form shown in FIGS. 12 and 13.

In the servo piston 321A the recess 309A is relatively large and is defined in a piston skirt 321B. The base end part of the skirt is internally chamfered to provide the part conical abutment surface 306A (FIG. 16).

In the actuating means 60, the movable member 324A is integral with the piston and accommodates part of the displacer resetting spring 308, and a front end portion 324B is shaped to form part of the discharge valve means 30, and serves to carry and locate two resilient "O" rings 333A and 333B between a backing flange 332B and a head 335A. The first "O" ring 333A serves as a seal, whereas the rear "O" ring 333B serves as a spring in place of the spring 336 shown in FIG. 12.

The head 335A is dimensioned so as to be a clearance fit in the discharge passage 331.

The integral member 315A is screwed into the base end portion 20 of the casing, and integrally incorporates a base end flange of the cartridge.

This modified form of cartridge is suitable for use with stored gas pressures of about 300 kilograms per square centimeter or more, and has a preferred working pressure range of between 200 and 300 kilograms per square centimeter, whereas some of the embodiments described hereinbefore are designed to work at lower pressures of, for example, 100 to 200 kilograms per square centimeter.

Furthermore, this modified form shown in FIGS. 15 to 17 is designed to improve the rate of discharge of the stored gas, and to operate reliably for a large number of charging and discharging cycles. For this purpose, the head 335A is shaped and positioned so that it is accommodated in one end of the discharge passage so as to substantially to block the discharge aperture 329 (FIG. 16) when the valve is closed. The first "O" ring 333A overlies the junction, and seals the junction, between the head and the discharge aperture whilst the valve is closed to prevent escape of gas. After initial actuation of the static thrust means 300, the initial rearwards movement of the piston will bring the head 335A to the transient position shown in FIG. 17, and in this position the head has moved nearly, but not completely, out of the discharge passage 331 and discharge opening 329, and has lifted the first "O" ring 333A off the wall 316 so that there is a clear space between the "O" ring 333A and the wall 316 whilst flow from the space 18 is obstructed by the head. When this transient position is reached the piston will have accelerated so that the head 335A passes through the transient position very rapidly to reach the fully open position shown in FIG. 16 is a fraction of a second after passing through the transient position. The blocking of the flow by the head 335A until the seal 333A has completely disengaged from the wall 316 greatly prolongs the useful working life of the seal 333A. This effect is present at least to some extent in the previously described embodiments also.

After discharge of the compressed gas, the spring 308A restores the piston 321A to the position shown in FIG. 15, and the part conical surface 311 causes the balls 301A to move radially outwards to the position shown in FIG. 15 also.

During recharging, compressed air is forced around the head 335A, which is a clearance fit in the discharge passage 331, and the compressed air forces the first "O" ring 333A off the wall 316 against the resilient bias provided by the second "O" ring 333B, thereby allowing the gas to enter the space 18. When the space is fully charged up to the supply pressure of the compressed gas, the second "O" ring 333B urges the seal 333A back into engagement with the wall 316 to close the valve, which thus serves as non-return valve means for charging.

The fourth embodiment and the modified form have the major advantage that if the round is overheated, e.g. by a fire, the seals ("O" rings) will melt and allow a slow leakage discharge of the gas, without any risk of an explosive discharge arising. The missile may be heavier than an air gun pellet. For example, a plastics or metal missile may be used having a weight of over one gramme, e.g. 2 to 4 gms., the missile 10A indicated in FIG. 15 having a weight of about 3 gms.

The invention is not confined to the precise details of the foregoing examples and many variations are possible within the scope of the invention as defined by the appended claims. For example, whilst the cartridge and fixed members are preferably made of metal, the piston in the first three embodiments is of lighweight metal or plastics material. In the fourth embodiment the piston is preferably of steel. The springs may be of metal or plastics material.

The retaining means may be of any suitable form; the detachable nosepiece may be omitted, and the discharge end portion of the cartridge may be provided with an "O" ring form of retaining means as shown in FIG. 1 of our British Patent Specification No. 1601917. The nosepiece or discharge end portion may have any suitable shape, e.g. to co-operate with a barrel liner of the form described in our British Patent Specifications Nos. 2044896, which Specification explains the advantages of forward loading of the pellet, which is also permitted by the detachable nosepiece of the ammunition described herein.

The cartridge of the invention has the further advantage which is not available from any known form of compressed air cartridge, that the firing pin may rebound after striking the actuating means without impairing the discharge of the gas. In this respect also, the cartridge of the invention is similar to ordinary firearms explosive cartridges. The base end part need not be exposed at the base end of the cartridge, even though the base end part has to be accessible for striking by a firing pin. For example, in order to reduce the risk of the cartridge being discharged accidentally or by tampering (by children) a protective and replaceable cap 350 may be provided to cover the aperture 323 as indicated in broken lines in FIGS. 1 and 16. Such a cap may be provided for any of the embodiments and must be of thin metal, plastics or other material which can be pierced by the firing pin, so that the base end part remains accessible for correct firing in a gun.

Various features and details of the several embodiments may be combined in many ways to yield a variety of other forms of cartridge employing the basic functional ideas disclosed herein. For example, the FIG. 5 embodiment may be varied by making the piston fixed to the rod; by omitting the spring 42 and the base end part 26; by providing the second wall, a frangible closure or servo-valve means at or adjacent to the base end of the cartridge and by providing a charging passage of restricted form through the piston, to convert the operation of the embodiment to a venting servo-valve form analogous to the FIG. 9 or 11 embodiment, the wall 17 of FIG. 9 embodiment now being a false or third wall disposed between the piston and the front wall 16 within the space 18 to serve as a guide for the member 25A, and the original space 18 being extended and supplemented by the space between the new second wall and the false wall 17 for storage of gas within the casing.

I claim:

1. A cartridge comprising:

(a) a hollow elongate casing having an intermediate portion between a rear base end portion and a front discharge end portion, (b) a gas storage space located in the intermediate portion for storing compressed gas, (c) discharge valve means having a valve member normally closing a gas discharge opening between said gas storage space and the front discharge end portion, (d) a hollow piston reciprocable in said base end portion, (e) a discharge valve actuating member extending from said piston through said gas storage space and connecting mechanically said valve member with the piston so that the discharge valve means is openable by rearward movement of said piston, (f) a fixed member in the rear base end portion and confronting said piston, said fixed member having a central aperture coaxial with said piston, and (g) actuating means comprising a plurality of rigid members in said base end portion and a displacer between said rigid members, (h) said displacer is disposed coaxially with respect to said piston, extends forwardly into said piston and rearwardly into said central aperture, and has a head section, (i) said rigid members are supported by said head section in a first position between said piston and fixed member to space said piston from said fixed member and to support said piston against a thrust exerted by the pressure in said gas storage space, (j) said displacer is drivable axially forwardly to slide the head section from between said rigid members allowing said rigid members to move radially inwardly to a second position in which they are encompassed by the piston, to allow the piston to pass axially rearwardly towards the fixed member in response to said thrust, and (k) a resetting spring abuts said displacer to exert a forward thrust on said piston for closing said valve means, and a rearward thrust on said displacer to urge the head between the rigid members for moving said rigid members from said second position to said first position.

2. A cartridge as defined in claim 1 wherein said rigid members are of spherical form.

3. A cartridge as defined in claim 1 wherein the valve member is arranged to move rearwardly through a predetermined distance while maintaining said gas discharge opening closed prior to opening said gas discharge opening as said piston passes rearwardly in response to said thrust.

4. A cartridge as defined in claim 1 wherein the piston has a tapered part conical abutment surface which engages said rigid members in said first position to cause said rigid members to exert a radially inwardly directed thrust on said head section.

5. A cartridge as defined in claim 1 wherein to the rear of said head section there is a part conical surface on said displacer to exert a radially outwardly directed thrust on said rigid members when said displacer is moved rearwardly to said resetting spring to move the rigid members from said second to said first position.

6. A cartridge as defined in claim 1 wherein a valve bias spring is located around said discharge valve actuating member to thrust said valve member forwardly and to allow said valve member to move rearwardly to admit compressed gas supplied to the discharge passage to enter the chamber for recharging the cartridge.

7. A cartridge as defined in claim 1 wherein the resetting spring is accommodated in said hollow piston.

* * * * *